US010907285B2

(12) United States Patent
Beyaert et al.

(10) Patent No.: US 10,907,285 B2
(45) Date of Patent: Feb. 2, 2021

(54) AUTOMATIC EDGE POSITIONING AND FABRIC GUIDING FOR SEWING MACHINES

(71) Applicant: Motiv NV, Waregem (BE)

(72) Inventors: Geert Oktaaf Maurice Beyaert, Heestert (BE); Stefaan René Vierstraete, Wevelgem (BE); Steven Goegebeur, Aalter (BE); Wim Jan George Matthys, Anzegem (BE); Steve Guy Robert Jacob, Anzegem (BE)

(73) Assignee: Motiv NV, Waregem (BE)

( * ) Notice: Subject to any disclaimer, the term of this patent is extended or adjusted under 35 U.S.C. 154(b) by 206 days.

(21) Appl. No.: 16/183,816

(22) Filed: Nov. 8, 2018

(65) Prior Publication Data

US 2019/0145033 A1 May 16, 2019

(30) Foreign Application Priority Data

Nov. 10, 2017 (BE) ..... 2017/5817

(51) Int. Cl.

| | |
|---|---|
| ***B65H 23/032*** | (2006.01) |
| ***B65H 23/038*** | (2006.01) |
| ***B65H 23/02*** | (2006.01) |
| ***D05B 35/10*** | (2006.01) |

(52) U.S. Cl.

CPC ..... *D05B 35/102* (2013.01); *B65H 23/0204* (2013.01); *B65H 23/038* (2013.01); *B65H 23/0324* (2013.01); *B65H 2301/4435* (2013.01); *B65H 2301/44318* (2013.01); *B65H 2404/142* (2013.01)

(58) Field of Classification Search

CPC ..... B65H 23/0204; B65H 23/0216; B65H 23/0322; B65H 23/0324; B65H 23/038; B65H 9/106

See application file for complete search history.

(56) References Cited

U.S. PATENT DOCUMENTS

| | | | |
|---|---|---|---|
| 3,147,898 | A | 9/1964 | Huck |
| 3,368,726 | A | 2/1968 | Funk |
| 4,726,501 | A | 2/1988 | Wiley |
| 4,919,318 | A | 4/1990 | Wong |

OTHER PUBLICATIONS

Belgium European Search Report completed Jul. 27, 2018, pertaining to BE 2017/5817 filed Nov. 10, 2017.

*Primary Examiner* — William E Dondero

(74) *Attorney, Agent, or Firm* — Dinsmore & Shohl, LLP

(57) ABSTRACT

Apparatus and methods are provided for automatic edge positioning and guiding of a moving web, such as a textile fabric or carpet, onto a conveyor system comprising manufacturing operations such as sewing, for example. More in particular an apparatus is provided including mechanics, optics and control for steering and positioning the side edges of the moving web in order to correct for misalignment, and hence sewing can occur appropriately.

14 Claims, 7 Drawing Sheets

AUTOMATIC EDGE POSITIONING AND FABRIC GUIDING FOR SEWING MACHINES

CROSS-REFERENCES TO RELATED APPLICATIONS

This application claims the benefit of priority under 35 U.S.C. § 119(a) to Belgian Application Serial No. 2017/5817, filed Nov. 10, 2017, which application is hereby incorporated by reference in its entirety.

TECHNICAL FIELD

The present disclosure relates to automatic guiding of a moving web, more in particular related to an apparatus including mechanics and optics for steering and positioning an edge of a moving web in order to correct for misalignment of the edge in the direction of travel of the conveyor onto which the web is guided.

BACKGROUND

For quite some years already, systems exist on the market for the guidance and alignment of moving webs, among which a conveyed woven or nonwoven fabric such as a carpet can be named. The use of pairs of guide rolls at opposite sides of the moving web can be found in the art acting to spread and guide the web, such that manufacturing operations such as e.g. sewing performed onto the moving web, can occur appropriately. Particularly in the case of sewing edges, it is necessary to accurately align and position the edges as they are being fed toward the sewing machine. Sensor and visualization techniques are currently used to assist in this alignment and edge positioning.

Among textile fabrics, carpets for instance are often bent or folded in multiple layers before guided on the conveyor table. This means that except from the edges, a folded configuration is moving ahead for further manufacturing operations. It is therefore desirable in some occasions that the guide rolls are provided as close as possible to the edges of the conveying system and not somewhere in the middle of the moving fabric.

Over recent years, mats and carpets have become lighter and more flexible. As a result edge positioning and guidance of these lighter fabrics is now more challenging than before, whereas the heavy carpet sticks as it were on the conveyor table. Moreover, more and more textile industry is now present in low cost countries where hot and humid environmental conditions are common, and hence simple though robust equipment including detection and monitoring is necessary.

There is an absolute need to follow and control the moving fabric, particularly in light and flexible configurations of today, especially at its edges, and steer continuously in a simple and automated manner to achieve correct alignment before the carpet is lead to the sewing machine for stitching or embroidery.

SUMMARY

Embodiments of this disclosure aim to provide automatic guiding of a moving web, such as a textile fabric or carpet, onto a conveyor system. More in particular embodiments are aimed at an apparatus comprising mechanics, optics, and control for steering and positioning the side edges of the moving web in order to correct for misalignment of these edges, while the web is moving forward onto the conveyor system, and needs to be positioned appropriately for being sewed for example with broidery at the edges.

According to a first aspect, an apparatus for steering an edge of a moving web is provided, comprising a moving conveyor and two pairs of rolls adjacent to at least one edge side of the moving conveyor. The moving web is for instance a textile fabric, such as a carpet, a mat or a rug while referring to tapestry. The two pairs of rolls are positioned next to one another along a transversal direction, and they are for example mounted close to and aside at both edges of the conveyor, along the length of the moving conveyor i.e. in parallel with the travel direction of the moving conveyor. The travel direction is the direction in which goods, here e.g. the textile webs, are propagated along the length of the moving conveyor. The transversal direction is defined as the perpendicular axis to the travel direction of the moving conveyor, connecting one edge side of the moving conveyor with the other.

Having the pairs of rolls next to each other means they are either in contact with each other or spaced apart from one another along their central axes, such that their opposing disk surfaces perpendicular to their central axes are spaced in parallel from one another or just contacting one another. The distance of the space separating the pairs of rolls is typically in the range of mm or cm.

The moving conveyor is for instance a conveyor system or table moving forward with a particular installable travel velocity. Per pair of rolls there is a first roll above and a second roll below the moving conveyor, wherein for each pair of rolls the first roll above and/or the second roll below can be moved along a vertical axis in relation to one another. The vertical axis is defined as being perpendicular to both travel direction and transversal direction, and thus all three together composing a 3-axis system.

The central axes of the first rolls are lying in line above the moving conveyor, whereas the central axes of the second rolls are lying in line below the moving conveyor. Moreover, the two pairs of rolls are mounted with their central axes perpendicular to the travel direction of the moving conveyor. Among these two pairs of rolls we have a first pair of rolls mounted in a fixed position along a transversal direction of the moving conveyor, meaning that along this transversal direction the first pair of rolls is fixed, although the first pair of rolls is not necessarily entirely fixed, i.e. the rolls can still be movable along other directions but the transversal direction.

A second pair of rolls is movably mounted along the transversal direction of the moving conveyor, meaning that these rolls can be moved closer to or further away from the first pair of rolls along this transversal direction. Hence, the distance between the adjacent rolls of the first and second pair respectively above and below the moving conveyor is variable along the transversal direction, whereas the second pair of rolls can be moved toward or away from the first pair of rolls along a transversal axis. The rolls of this second pair are moved together along the transversal axis, and at the same pace or velocity. In other words, the second pair rolls move as pair from one point on the transversal axis to another, bringing them closer to or further away from the first pair rolls. This way, the first rolls of first and second pair above the moving conveyor are brought together or apart, while at the same time the second rolls of first and second pair below the moving conveyor are moved similarly with the same distance from each other and at the same pace as the first rolls of first and second pair above the moving conveyor.

According to an embodiment, the first roll and second roll of the two pairs of rolls are configured to simultaneously move in opposite direction along the vertical axis, such that the first and second roll are at the same time, either moved closer, and herewith closing a pair of rolls, or moved further away from one another, and herewith opening the pair of rolls. The terminology of opening or closing a pair of rolls is further referred in the text, and means having both first and second roll of a particular pair of rolls move toward or away from each other.

Alternatively, in embodiments, only the first roll of the two pairs of rolls is configured to move along the vertical axis, such that the first roll is either moved closer, and herewith alternatively closing a pair of rolls, or moved further away from the second roll, and herewith alternatively opening the pair of rolls. Theoretically speaking, the same philosophy could also be applied with only the second roll of the two pairs being configured to move along the vertical axis, although in practice this could be less the case. The terminology of alternatively opening or closing a pair of rolls is further referred in the text, and means having only first (or second) roll of a particular pair of rolls move toward second (or first) roll or away from second (or first) roll. The second (or first) roll of the two pairs of rolls is then fixedly mounted along the vertical axis, closely below the movable conveyor such that when the first (or second) roll above (or below) is moved closer, more in particular as close as possible, the first and second roll make contact with their outer circle circumference surfaces.

According to yet another embodiment, the two pairs of rolls are configured for simultaneously opening and closing in opposite directions.

Further, in embodiments the first pair of rolls is driven by a first motor for rotational movement of the first pair rolls, the second pair of rolls is driven by a second motor for rotational movement of the second pair rolls, and the second pair of rolls is further driven by a third motor for transversal movement of the second pair rolls. All three motors can be connected or disabled separately. By means of the first and second motor, all rolls i.e. above and below the moving conveyor, of first and second pair are continuously driven for rotational movement. The rotational movement of the rolls is defined around their central axis. The rolls rotate at a certain rotational speed being directly related or even synchronized with the travelling velocity of the moving conveyor. The rotational speed of the rolls is adaptable, whereas the travelling velocity of the moving conveyor can be changed over time, along need and application, and is thus configurable by means of a further, fourth motor located and installed at the intake of the conveyor, for driving this conveyor at desired or requested speed.

Moreover, per pair of rolls the rotational speed of the rolls can further be slightly increased or decreased such that the rotational speed of the first pair rolls is slightly higher or slower than the rotational speed of the second pair rolls. With transversal movement is meant the movement along transversal direction as mentioned above. The first and second motor may further provide in translational movement of respectively the first and second pair of rolls along the vertical axis. The translational movement of the rolls along vertical axis as described means that the rolls are lifted up or down, and thus moved closer toward or further away from each other. Hence, this translational movement is related to the opening and closing, or alternatively opening or closing of a pair of rolls as defined previously.

In accordance to yet further embodiment, the apparatus comprises at least one photodiode along the edge side of the moving conveyor. The at least one photodiode is for instance located close to the first pair of rolls, more particularly just behind the contact surface of outer circle circumference surfaces of the first and second roll of the first pair. This contact surface of the first and second rolls of the first pair becomes clear when the first pair of rolls is closed, and herewith positioned for holding the moving web against the edge side of the moving conveyor. A further photodiode can be located just in front of the two pairs of rolls. According to an embodiment, a plurality of photodiodes is provided with the apparatus including a sewing machine, comprising the at least one and the further photodiode mentioned, and yet another photodiode at the intake of the sewing machine.

According to a second aspect, a method for automatic alignment of an edge of a moving web is provided, comprising the steps of (a) guiding the moving web onto the moving conveyor, provided with two pairs of rolls adjacent to at least one edge side of the moving conveyor, toward the two pairs of rolls, (b) holding the moving web at the edge by a first pair of rolls while at least one of the rolls of a second pair of rolls is lifted away from the moving web, and (c) holding and pulling the moving web toward the edge side of the moving conveyor by the second pair of rolls while at least one of the rolls of the first pair of rolls is lifted away from the edge of the moving web.

According to an embodiment, the method further provides for step (b) that the first and/or second roll of the first pair of rolls are moved closer to one another, hereby closing the first pair of rolls, when the first and/or second roll of the second pair of rolls are moved further away from one another, hereby opening the second pair of rolls, the first pair of rolls herewith holding the moving web against the edge side of the moving conveyor.

According to another embodiment, the method further provides for step (c) that the first and/or second roll of the first pair of rolls are moved further away from one another, hereby opening the first pair of rolls, when the first and/or second roll of the second pair of rolls are moved closer to one another, hereby closing the second pair of rolls, the second pair of rolls herewith holding the moving web against the moving conveyor and pulling the moving web toward or away from the edge side of the moving conveyor through a transversal movement of said second pair of rolls.

In other words, holding the moving web as mentioned implies for example that the first and second pair of rolls open and close, or alternatively open and close in an alternating way. Holding the moving web with a pair of rolls is made available by closing or alternatively closing this pair of rolls. Whenever this happens, at the same time, the other pair of rolls will open or alternatively open. This way, the moving web is always held by one of the two pairs, such that at any time enough freedom of movement is remained for the moving web, in order to facilitate its steering, guiding and correction of edge alignment.

At any time during processing, including during holding, all rolls of the two pairs keep on rotating, as being driven by a first and second motor, and the moving conveyor continues moving ahead. Pulling of the moving web toward the edge side of the moving conveyor is only achieved with the second pair of rolls, whereas this second pair of rolls is particularly driven by a third motor for transversal movement of the rolls. The moving conveyor is driven by a further, fourth motor, for movement along a travel direction, i.e. along the length of the conveyor.

According to an embodiment, the rolls of the first pair are thicker (wider) than the rolls of the second pair (thinner). Herewith, the first pair rolls can better exert force i.e. have a larger contact surface to hold the moving web, whereas the second pair rolls being less thick represent a better gripping force to pull the moving web toward the edge side of the moving conveyor. According to further embodiment, the rolls comprise a particular coating, structured or non-structured layer onto their outer circle circumference surfaces for improving or optimizing contact with the moving web for either holding or pulling actions.

Moreover, particularly referring to second aspect regarding a method for automatic alignment of an edge of a moving web, a further problem is solved at the same time. The well-known problem of bowing in for example carpet manufacturing, or other textile industry dealing with edge finishing or edge processing, is meanwhile solved. With bowing is understood, the bending or curling of the carpet or textile fabric at its edges due to forces exerted thereon during edge processing or the weaving process.

In a further embodiment, the method comprises the steps of (d) detecting and monitoring position of the edge of the moving web by means of at least one photodiode provided along the edge side of the moving conveyor, (e) holding and pulling the moving web of steps (b) and (c) by means of the two pairs of rolls based on detected and monitored position of the edge in step (d). The at least one photodiode is for instance located close to the first pair of rolls, more particularly just behind the contact surface of outer circle circumference surfaces of the first and second roll of the first pair. A continuous feedback of the edge position of the moving web can support in guiding, steering and correction of edge alignment, during operation or processing of the method.

According to a third aspect, a data processing system is disclosed comprising means for carrying out the method for automatic alignment of an edge of a moving web according to the second aspect previously described. Moreover, a data processing system for applying the method for automatic alignment of an edge of a moving web as mentioned above is also provided.

According to a fourth aspect, a computer program is disclosed comprising software code adapted to perform the method for automatic alignment of an edge of a moving web according to second aspect, previously described. In addition to an apparatus, an edge alignment method and a data processing system, embodiments of this disclosure relate also to a computer program representing the corresponding software code in order to perform the method for automatic alignment of an edge of a moving web as mentioned above.

According to a fifth aspect, a computer readable storage medium comprising the computer program according to fourth aspect, i.e. comprising software code adapted to perform the method for automatic alignment of an edge of a moving web according to the second aspect.

As a final aspect, embodiments of this disclosure are directed to a computer readable storage medium comprising the computer program with the software code.

Additional features and advantages of the embodiments described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 1:
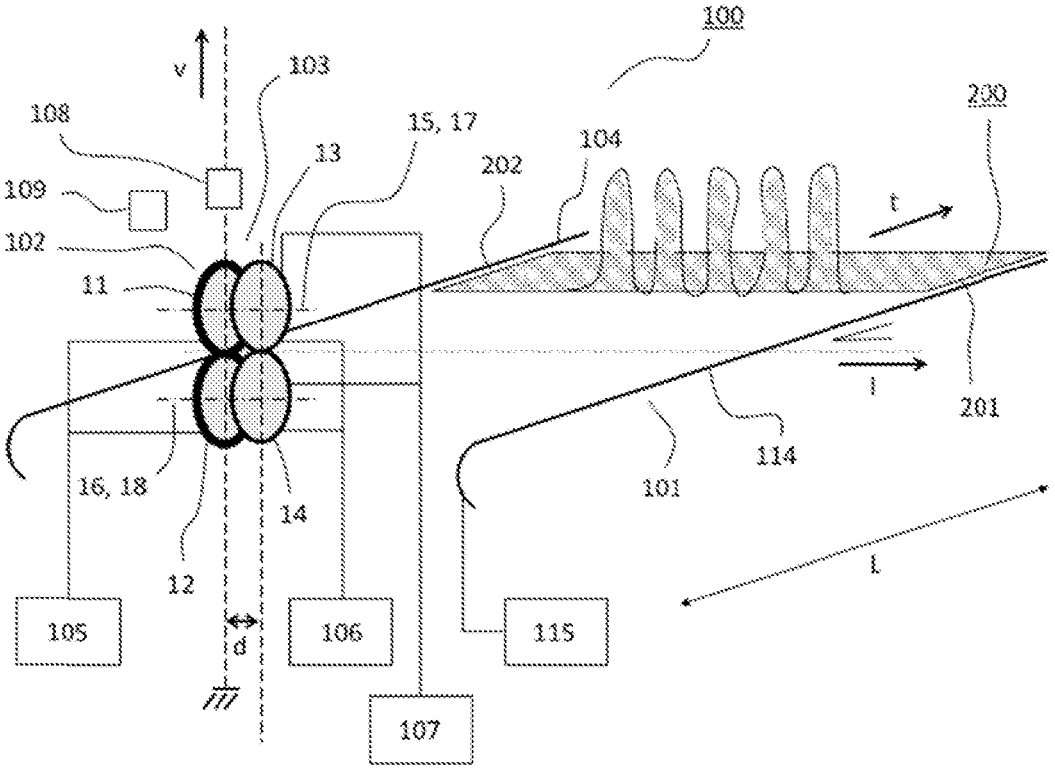
FIG. 1 illustrates schematically an embodiment of the apparatus for steering an edge of a moving web.

FIG. 1 shows an embodiment providing an apparatus 100 for steering the edges 201, 202 of a moving web 200, as for example a carpet. The apparatus 100 comprises a moving conveyor 101, such as for instance a conveyor table, driven by a motor 115 for moving forward the conveyor 101 in a travel direction t along the length L of the conveyor 101 and with a controllable speed. The carpet 200 is put onto the moving conveyor 101 for further processing, e.g. for broidery or sewing the carpet edges 201, 202. Therefore, the moving carpet 200 is to be aligned along its edges 201, 202 on the conveyor 101 such that further processing can be done appropriately and accurately. It is noted that the carpet 200 is folded away from its edges 201, 202 whereas it is too large to be entirely spread over the moving conveyor 101. As shown, the apparatus 100 further comprises two pairs 102, 103 of rolls adjacent to the edge side 104 of the moving conveyor 101.

Although here in FIG. 1 two pairs 102, 103 of rolls are depicted at only one edge side 104, according to a further embodiment both edge sides 104, 114 have the pairs of rolls installed. The first pair 102 comprises the rolls 11, 12 whereas the second pair comprises the rolls 13, 14. All rolls are mounted such that the central axis 15, 16, 17, 18 of each of the rolls 11, 12, 13, 14 respectively is perpendicular to the travel direction t. In other words, the central axis 15, 16, 17, 18 of each of the rolls 11, 12, 13, 14 respectively is lying along (or parallel to) the transversal direction 1, being perpendicular to the travel direction t as indicated in FIG. 1 with the rectangle symbol.

Figure 3:
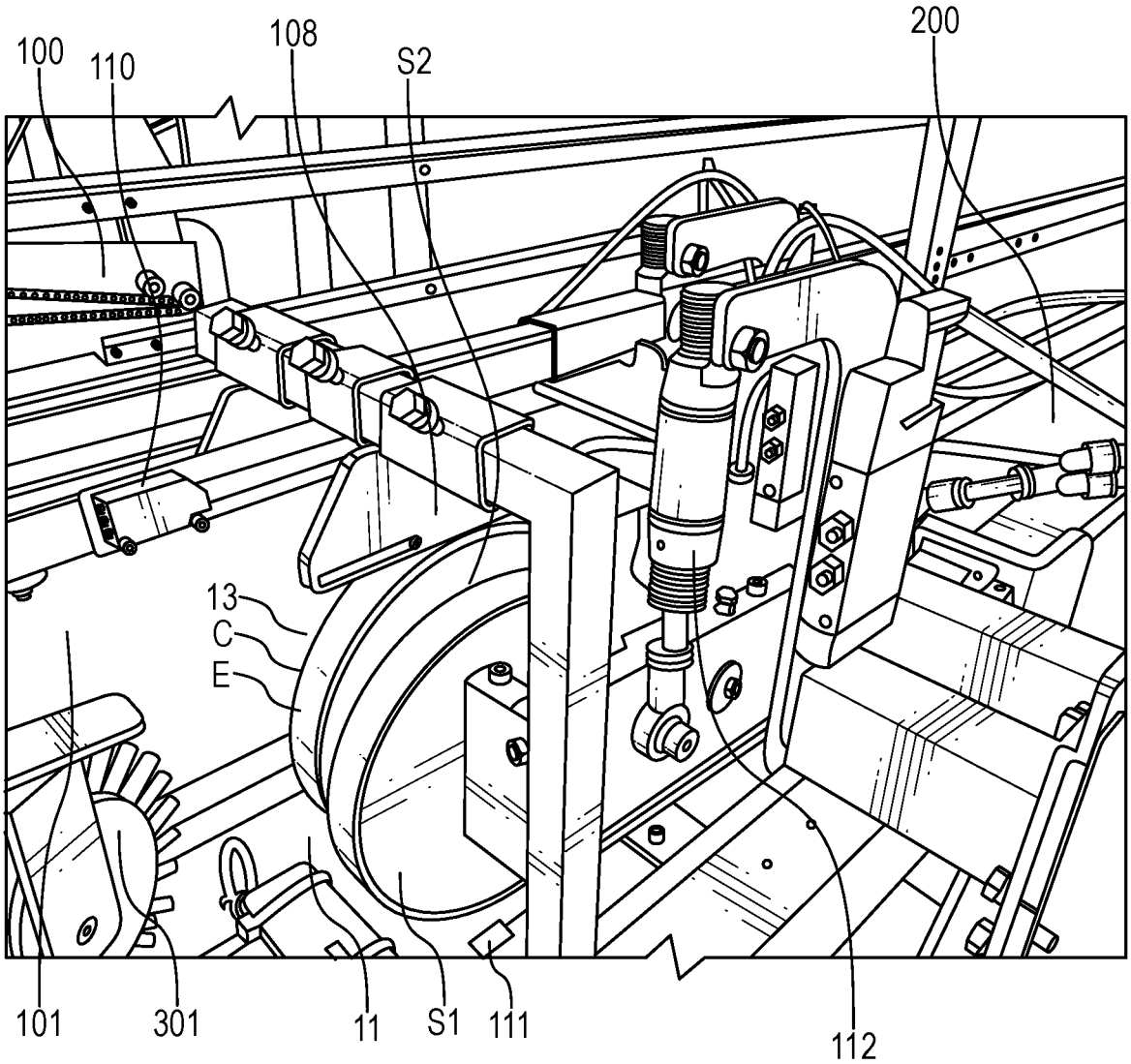
FIG. 3 shows a picture view of an embodiment of the apparatus for steering an edge of a moving web.

While referring now to FIG. 3, according to an embodiment each roll 11, 12, 13, 14 of both pairs 102, 103 comprises an outer circle circumference C and an outer edge surface E. Here, the outer circle circumference C is for all rolls the same, whereas the outer edge surface E can vary per pair since the edge thickness T of the rolls may vary.

Figure 6:
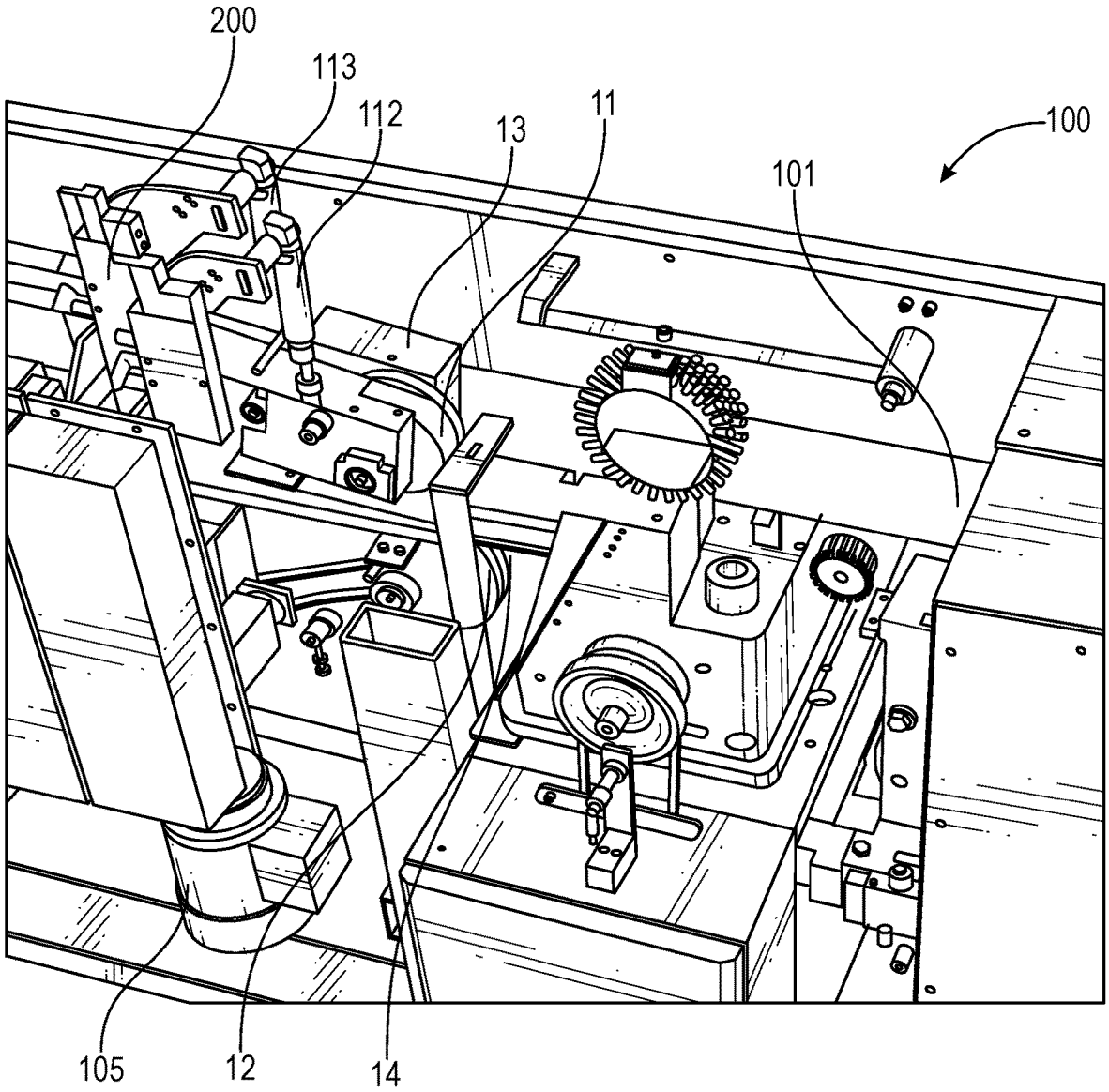
FIG. 6 shows a perspective view of an embodiment of the apparatus for steering an edge of a moving web.
Figure 7:
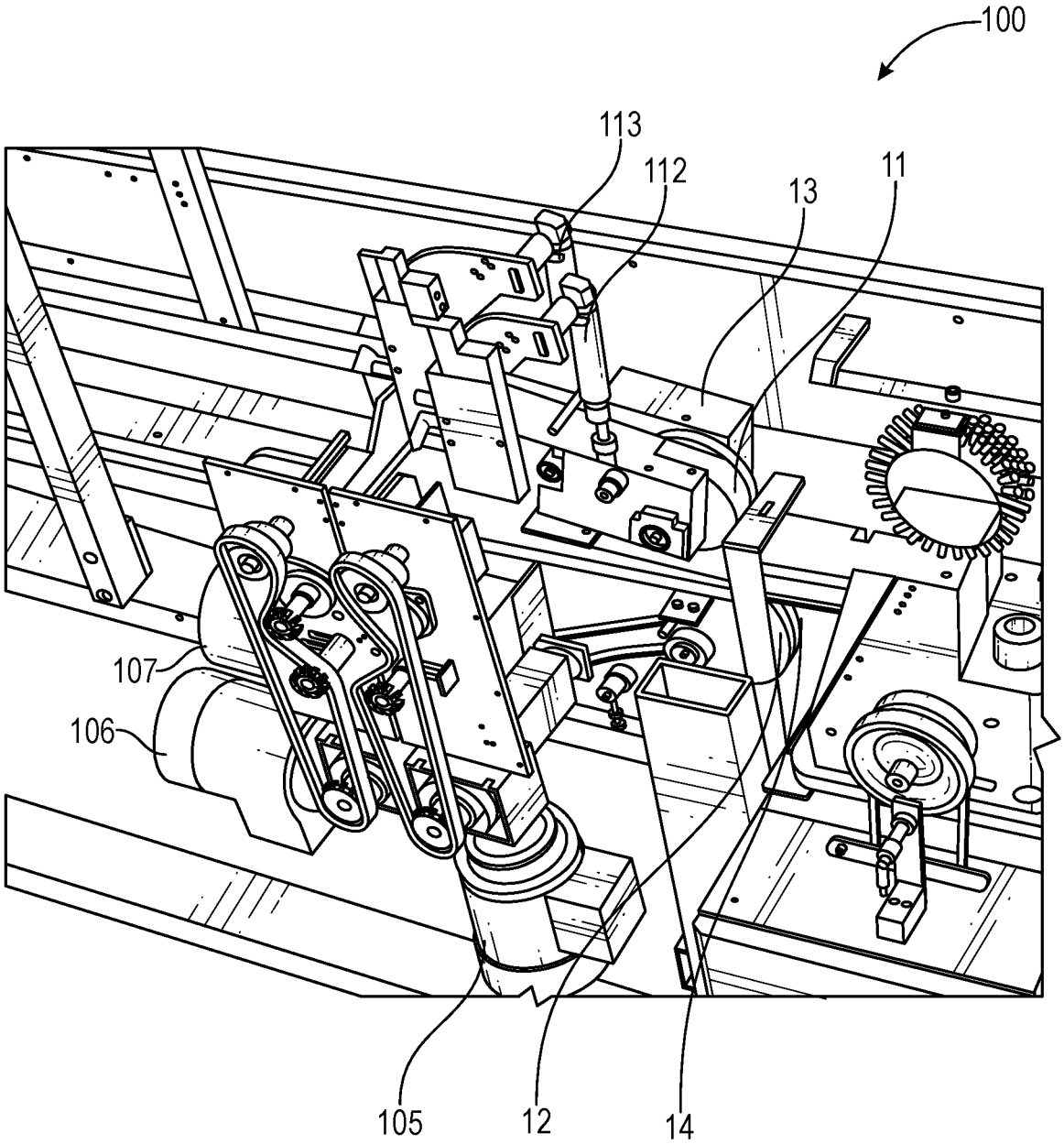
FIG. 7 shows another view of the embodiment of FIG. 6.
Figure 8:
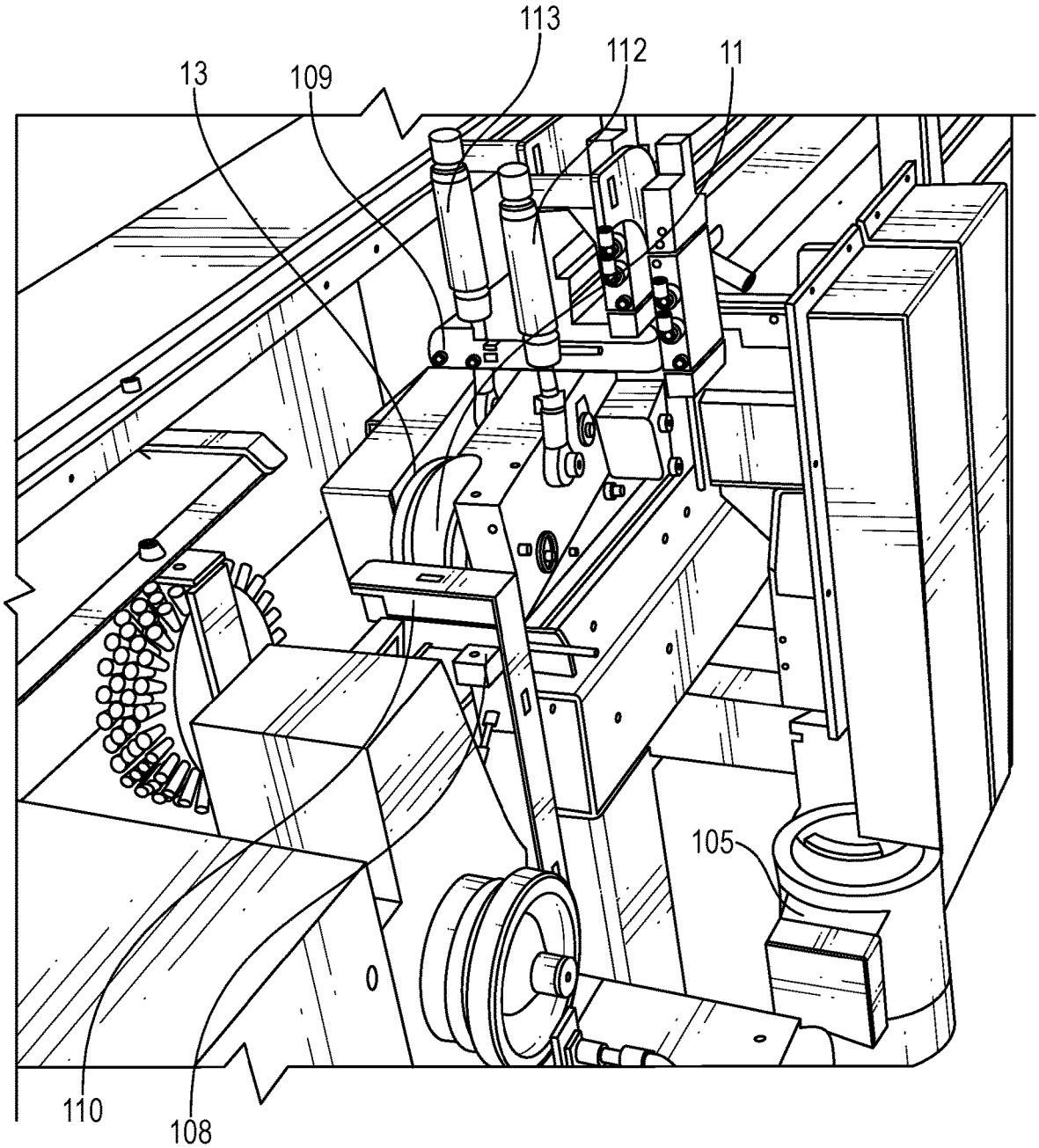
FIG. 8 shows yet another view of the embodiment of FIG. 6.

In an embodiment, as illustrated in FIG. 6, FIG. 7 and FIG. 8 the rolls of the first pair 102, i.e. the first pair rolls 11, 12 have a larger edge thickness T, and hence larger outer edge surface E than the rolls of the second pair 103, i.e. the second pair rolls 13, 14, whereas the first pair 102 is in essence related to holding and the second pair 103 is related to both holding and gripping functionality. Moreover each roll has a circle surface S1 and a parallel circle surface S2, whereas S1 being the surface closest to the edge side 104 of the moving conveyor 101.

Returning back to FIG. 1, the first pair 102 of rolls is positioned at the outer edge side 104 of the conveyor 101, and comprises a first roll 11 above and a second roll 12 below the conveyor table 101. Next to the first pair 102, at a distance d, the second pair 103 of rolls is mounted, comprising also a first roll 13 above and a second roll below the conveyor table 101. The distance d is defined as the perpendicular circle surface-to-circle surface distance of the first rolls 11, 13, and or either of the second rolls 12, 14 respectively of the two pairs 102, 103. In other words, the distance d is the perpendicular distance between the circle surface S2 of the first pair first roll 11 and the circle surface S1 of the second pair first roll 13, and or either between the circle surface S2 of the first pair second roll 12 and the circle surface S1 of the second pair second roll 14. Or else, the distance d is the distance between first pair 102 and second pair 103 of rolls along the transversal direction 1. This distance d is moreover variable, which means that the second pair 103 of rolls can be moved closer to or further away from the first pair 102 of rolls along the transversal direction 1, whereas the first pair 102 of rolls is in fixed transversal position, as indicated in FIG. 1. The larger the distance d, the more the second pair 103 of rolls is moved toward the center of the conveyor 101. On the other hand, both first pair 102 and second pair 103 of rolls are movable along a vertical direction v, meaning that first roll 11, 13 of the two pairs is movable along this vertical direction v.

The first roll 11, 13 of first 102 and second 103 pair respectively can be moved closer to or further away from the movable conveyor 101. Bringing the first roll 11, 13 closer to the movable conveyor 101, and hence bringing the first roll 11, 13 closer to the corresponding pair second roll 12, 14 is also referred to as closing the pair 102, 103 of rolls. Whenever both pairs 102, 103 are closed, the central axes 15, 17 of the first rolls 11, 13 are lying in line or coincide. Similarly, at the same time, the central axes 16, 18 of the second rolls 12, 14 are then also lying in line, or are coinciding. Moving the first roll 11, 13 further away from the movable conveyor 101, and hence moving in the first roll 11, 13 further away from the corresponding pair second roll 12, 14 is also referred to as opening the pair 102, 103 of rolls.

According to an embodiment, the two pairs 102, 103 of rolls will never simultaneously open or close. On the contrary, the two pairs 102, 103 of rolls will always open and close in an alternating way, meaning that whenever the first pair 102 of rolls is closing, the second pair 103 of rolls will open and vice versa.

According to a particular embodiment, the second roll 12, 14 of the two pairs is also movable along the vertical direction v. In combination with the vertical movement (along the vertical direction v) of the first roll 11, 13, the second roll 12, 14 of first 102 and second 103 pair respectively is moved closer to or further away from the movable conveyor 101. Bringing the first roll 11, 13 and the second roll 12, 14 closer to the movable conveyor 101, and hence bringing the first roll 11, 13 and the second roll 12, 14 closer to each other is now referred to as closing the pair 102, 103 of rolls. Whenever both pairs 102, 103 are closed, the central axes 15, 17 of the first rolls 11, 13 are lying in line or coincide. Similarly, at the same time, the central axes 16, 18 of the second rolls 12, 14 are then also lying in line, or are coinciding. Moving the first roll 11, 13 and the second roll 12, 14 further away from the movable conveyor 101, and hence moving the first roll 11, 13 further away from the second roll 12, 14 is now referred to as opening the pair 102, 103 of rolls.

According to a more particular embodiment, the two pairs 102, 103 of rolls will never simultaneously open or close during edge alignment operation of the apparatus 100, but will always open and close in an alternating way, meaning that whenever the first pair 102 of rolls is closing, the second pair 103 of rolls will open and vice versa. During edge alignment, opening and closing of the two pairs 102, 103 of rolls is further accompanied by transversal displacement (direction 1) of the second pair 103 of rolls as further detailed below.

In an embodiment, and as illustrated in FIG. 1, the first pair 102 of rolls is driven by a motor 105 for rotational movement of these first pair rolls 11, 12 whereas the second pair 103 of rolls is driven by another motor 106 for rotational movement of the second pair rolls 13, 14. Furthermore, the second pair 103 of rolls is driven by a motor 107 for transversal movement, i.e. movement along the transversal direction 1, of the second pair rolls 13, 14. All three motors 105, 106, 107, together also depicted in FIG. 7, can be connected or disabled separately. By means of the motors 105, 106 all rolls i.e. above and below the moving conveyor 101, of first and second pair 102, 103 are continuously driven for rotational movement.

The rotational movement of the rolls 11, 12, 13, 14 is defined around their central axis 15, 16, 17, 18 respectively. The rolls 11, 12, 13, 14 rotate at a certain rotational speed being directly related or even synchronized with the travelling speed or velocity of the moving conveyor 101. The rotational speed of the rolls 11, 12, 13, 14 is hence adaptable, whereas the travelling speed or velocity of the moving conveyor 101 can be changed over time, along need and/or application, and is thus configurable by means of the motor 115 located and installed at the intake of the moving conveyor 101, for driving the conveyor 101 at desired or requested speed. Moreover, per pair 102, 103 of rolls the rotational speed of the rolls can further be slightly increased or decreased such that the rotational speed of the first pair rolls 11, 12 is slightly higher or slower than the rotational speed of the second pair rolls 13, 14. With transversal movement is meant the movement along transversal direction 1 as mentioned above.

The motors 105, 106 may further provide in translational movement of respectively the first 102 and second 103 pair of rolls along the vertical axis v. The translational movement of the rolls along vertical axis v as described means that the rolls are lifted up or down, and thus moved closer toward or further away from each other. Hence, this translational movement is related to the opening and closing of a pair 102, 103 of rolls as defined previously.

Figure 4:
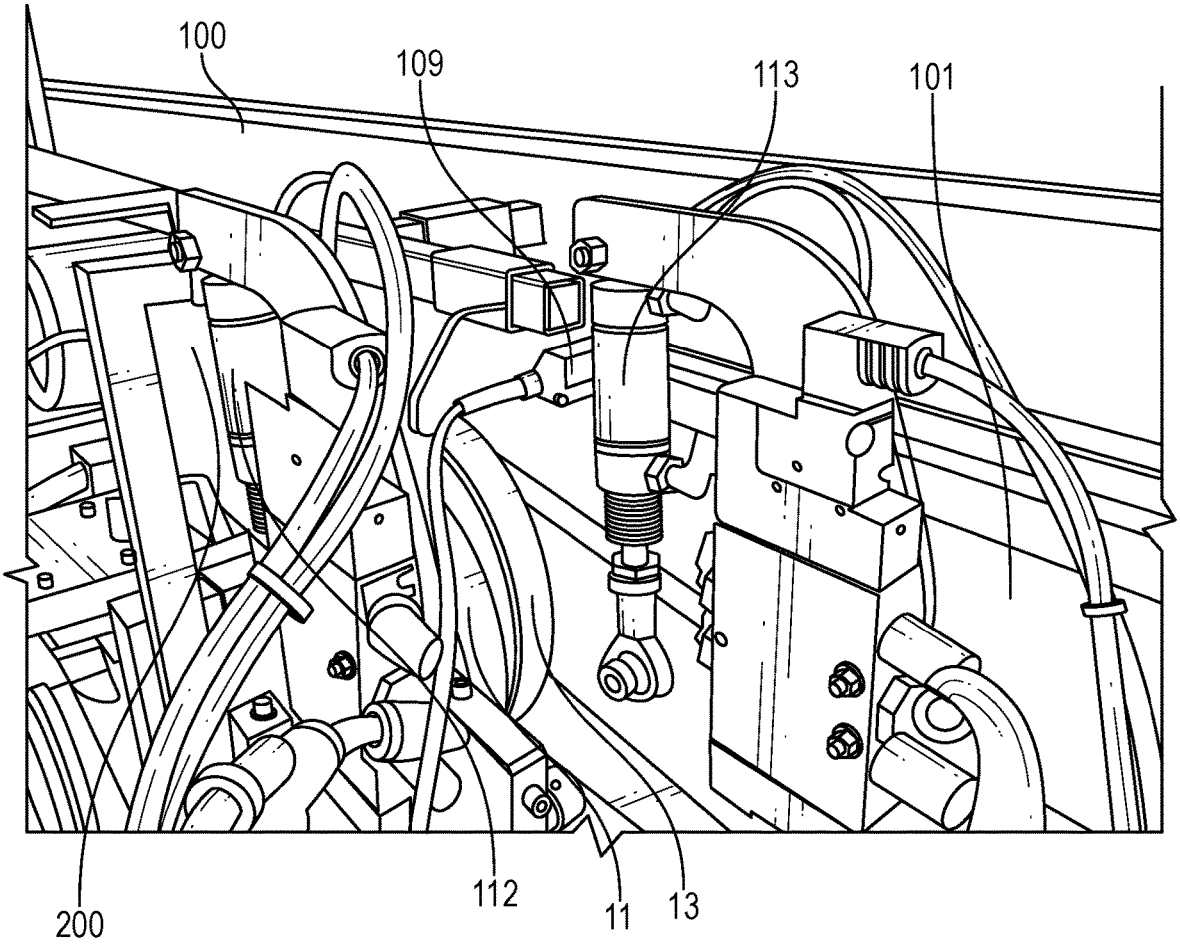
FIG. 4 shows another picture view of the embodiment of FIG. 3.

As illustrated in the picture views of FIG. 3 and FIG. 4, and further depicted in FIG. 6, FIG. 7 and FIG. 8, pneumatic cylinders 112, 113 are also part of the set-up, and are connected with the driving system, i.e. more in particular with either one of the motors 105, 106 respectively, while supporting the vertical translational movement for lifting up or down the rolls 11, 13.

Figure 2:
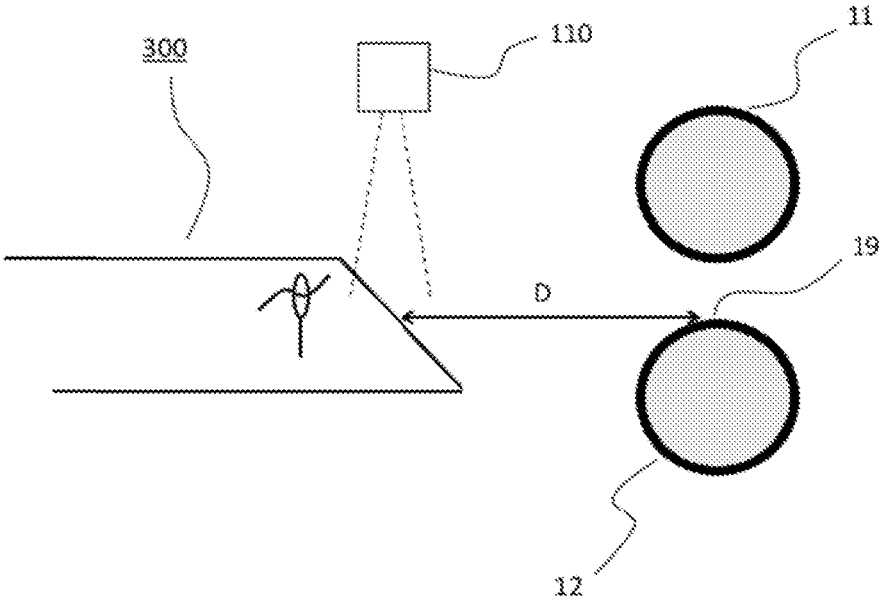
FIG. 2 illustrates schematically an embodiment of part of the apparatus for steering an edge of a moving web, more in particular in the area of the sewing machine.

Further schematically depicted in FIG. 1 and FIG. 2, and shown in the picture views of FIG. 3 and FIG. 4, and illustrated in FIG. 8, are the photodiodes 108, 109, 110 along the edge side 104 of the moving conveyor 101. The photodiode 108 is located close to the first pair 102 of rolls, more particularly just behind the contact surface 19 of outer circle circumference surfaces of the first and second roll 11, 12 of the first pair 102. This contact surface 19 of the first and second roll 11, 12 of the first pair 102 is the area where the first and second roll 11, 12 make contact whenever the first pair 102 of rolls is closed. By closing the first pair 102, the rolls 11, 12 are positioned for holding the folded carpet 200 against the edge side 104 of the moving conveyor 101. A further photodiode 109 is located just in front of the two pairs 102, 103 of rolls. According to an embodiment, the apparatus 10 further comprises a sewing machine 300 as illustrated FIG. 2 and partly in FIG. 3 while referring to guiding roll 301 of the sewing machine 300. Yet another photodiode 110 is herewith depicted, more specifically at the intake of the sewing machine 300. The sewing starts at a distance D from the first pair 102 rolls contact surface 19. In an embodiment, this distance D is between 20 mm and 100 mm, i.e. not too far away from the edge alignment mechanism with the two pairs 102, 103 of rolls, and hence for having the correct edge alignment close enough to the intake of sewing, herewith not leaving the carpet 200 the opportunity to have its edge misaligned again when the manufacturing operation of sewing needs to take off.

Figure 5:
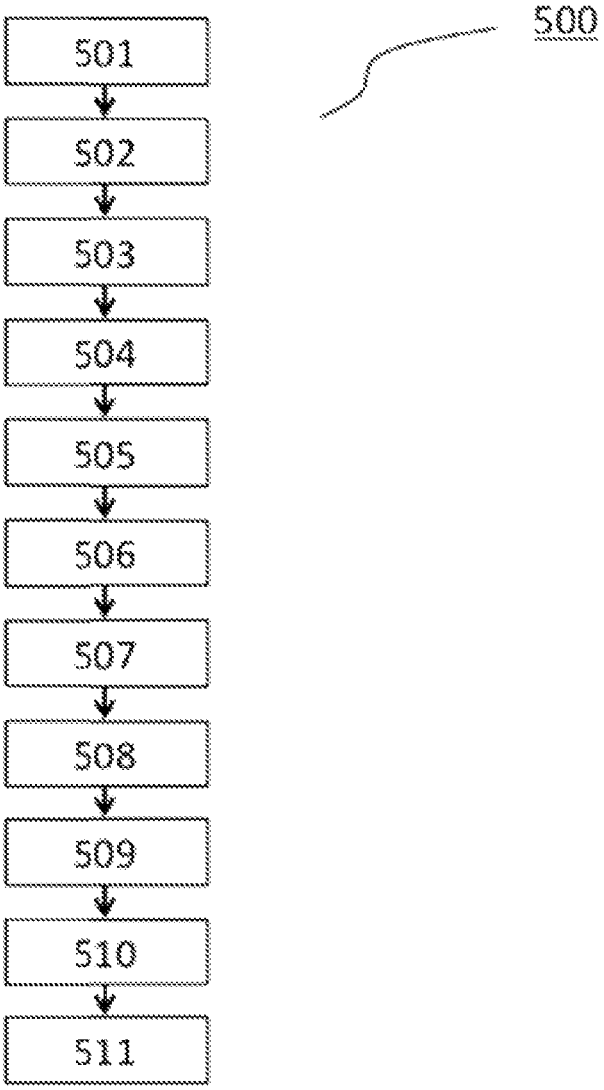
FIG. 5 illustrates a flow chart of an embodiment of the edge alignment method.

While referring further to FIG. 1, and FIG. 5 in particular, an embodiment of the method for automatic alignment of the edges 201, 202 of the carpet 200 is now described into more detail.

As indicated with step 501 in the edge alignment method flow chart 500, the large carpet 200 is folded in the middle such that it can be put on the conveying table 101, having its edges 201, 202 brought as close as possible to the conveying edge sides 104, 114. Conveying is enabled by means of the motor 115 in the travel direction t.

With step 502, the carpet 200 is then guided toward the rolls 11, 12, 13, 14 for edge alignment, such that correct positioning is achieved before intake of the sewing machine 300. Only the rolls 11, 12, 13, 14 at one edge side 104 are considered in the description although edge alignment at both edge sides 104, 114, and hence another two pairs of rolls at the other edge side 114 is understood according to an embodiment. Moreover, only the edge alignment of one edge 201 of the moving carpet 200 is further described, whereas edge alignment for both edges 201, 202 is understood according to an embodiment.

Step 503 refers to detection and monitoring of the carpet edge 201, more particularly the position and alignment of the carpet edge 201 at the intake of the rolls 11, 12, 13, 14, and for which a photodiode 109 can be used.

Following step 504 deals with transferring this detection and monitoring information toward a control and steering system, in connection with the driving motors 105, 106, 107 for the rolls 11, 12, 13, 14. This way, the rolls are controlled for holding and/or pulling the moving carpet 200 and herewith adjusting position against edge misalignment.

Next step 505 refers to holding the carpet 200 by means of the first pair 102 of rolls, while at the same time the second pair 103 of rolls is not in contact with the carpet 200 but lifted or opened. The first pair 102 of rolls is closed meaning that first roll 11 of first pair 102 is brought closer to second roll 12 of first pair 102, or both first pair rolls 11, 12 are brought closer to each other, in such a way that the rolls 11, 12 together clamp and hold the moving carpet 200, while continuously rotating around their central axes 15, 16 and herewith guiding or propagating further the moving carpet 200.

Consecutively, in step 506 the first pair 102 of rolls is opened, meaning that first roll 11 of the first pair 102 is lifted away e.g. lifted upward with motor 105 and/or pneumatic cylinder 112 from second roll 12 of first pair 102. Simultaneously, the second pair 103 of rolls is being closed, meaning that first roll 13 of the second pair 103 is brought down e.g. lifted downward with motor 106 and/or pneumatic cylinder 113 toward second roll 14 of second pair 103. Hence the second pair rolls 13, 14 are now holding the moving carpet 200, while continuously rotating around their central axes 17, 18 for further guiding the carpet 200.

In addition, while referring to step 507, the second pair 103 of rolls is not only holding the carpet 200, but also pulling the carpet 200 while also driven by motor 107 for generating transversal movement (along direction 1). In other words, guidance of the carpet 200 is not only in the travel direction t due to control and steering of motor 106, but including in the transversal direction 1 and herewith guiding the carpet edge 201 toward the edge side 104 of the moving conveyor 101. The principle of edge alignment and correcting or adjusting for edge misalignment is herewith accomplished.

As indicated with step 508, the position of the carpet edge 201 is further detected and monitored with another photodiode 108 in the area of the first pair 102 of rolls, such that further feedback for control and steering can be transmitted toward the driving motors 105, 106, 107 of the rolls 11, 12, 13, 14.

Additional steps 509, 510, 511 refer to guiding the carpet 200 toward the sewing machine 300, detecting and monitoring position of the carpet edge 201 at the intake of the sewing machine 300 using photodiode 110, and starting sewing respectively.

What is claimed is:

1. An apparatus for steering an edge of a moving web, the apparatus comprising:

a moving conveyor; and two pairs of rolls adjacent to at least one edge side of said moving conveyor, the two pairs of rolls comprising per pair of rolls a first roll above and a second roll below said moving conveyor, wherein:

for each pair of rolls said first roll above and/or said second roll below can be moved along a vertical axis in relation to one another;

said two pairs of rolls are mounted with their central axes perpendicular to the travel direction of said moving conveyor; and said two pairs of rolls comprise a first pair of rolls mounted in a fixed position along a transversal direction of said moving conveyor and a second pair of rolls movably mounted along said transversal direction of said moving conveyor, such that the distance between adjacent rolls of said first and second pair respectively above and below said moving conveyor is variable along said transversal direction.

2. The apparatus of claim 1, wherein said first roll and said second roll of said two pairs of rolls are configured to simultaneously move in opposite direction along said vertical axis, such that said first and second roll are at the same time, either moved closer, thereby closing a pair of rolls, or moved further away from one another, thereby opening said pair of rolls.

3. The apparatus of claim 2, wherein said two pairs of rolls are configured for simultaneously opening and closing in opposite directions.

4. The apparatus of claim 1, wherein only said first roll of said two pairs of rolls is configured to move along said vertical axis, such that said first roll is either moved closer, to said second roll, and thereby alternatively closing a pair of rolls, or moved further away from said second roll, and thereby alternatively opening said pair of rolls.

5. The apparatus of claim 4, wherein said second roll of said two pairs of rolls is fixedly mounted along said vertical axis, closely below said movable conveyor such that when said first roll above is moved closer, more in particular as close as possible, said first and second roll make contact with their outer surfaces.

6. The apparatus of claim 1, wherein said first pair of rolls is driven by a first motor for rotational movement of said first pair rolls, said second pair of rolls is driven by a second motor for rotational movement of said second pair rolls, and said second pair of rolls is further driven by a third motor for transversal movement of said second pair rolls.

7. The apparatus of claim 6, wherein said first and second motor further provide in translational movement of respectively said first and second pair of rolls along said vertical axis.

8. The apparatus of claim 1, comprising at least one photodiode along said edge side of said moving conveyor.

9. The apparatus of claim 8, wherein said at least one photodiode is located close to said first pair of rolls, more particularly just behind the contact surface of outer circle circumference surfaces of said first and second roll of said first pair.

10. The apparatus of claim 9, further comprising a further photodiode located in front of said two pairs of rolls.

11. A method for automatic alignment of an edge of a moving web, the method comprising:

(a) guiding said moving web onto a moving conveyor, provided with two pairs of rolls adjacent to the same edge side of said moving conveyor, toward said two pairs of rolls;

(b) holding said moving web at said edge by a first pair of rolls while at least one of the rolls of a second pair of rolls is lifted away from said moving web; and (c) holding and pulling said moving web toward said edge side of said moving conveyor by said second pair of rolls while at least one of the rolls of said first pair of rolls is lifted away from said edge of said moving web.

12. The method of claim 11, wherein (b) comprises moving said first and/or second roll of said first pair of rolls closer to said edge side of said moving conveyor, and when said first and/or second roll of said second pair of rolls are moved further away from said edge side of said moving conveyor, said first pair of rolls herewith holding said moving web against said edge side of said moving conveyor.

13. The method of claim 11, wherein (c) comprises moving said first and/or second roll of said first pair of rolls further away from said edge side of said moving conveyor, and when said first and/or second roll of said second pair of rolls are moved closer to said edge side of said moving conveyor, said second pair of rolls herewith holding said moving web against said moving conveyor and pulling said moving web toward or away from said edge side of said moving conveyor.

14. The method of claim 11, further comprising:

(d) detecting and monitoring position of said edge of said moving web by means of at least one photodiode provided along said edge side of said moving conveyor; and (e) holding and pulling said moving web of (b) and (c) with said two pairs of rolls based on detected and monitored position of said edge in (d).

* * * * *